US005096063A

United States Patent [19]

Schreiter

[11] Patent Number: 5,096,063

[45] Date of Patent: Mar. 17, 1992

[54] INTERLOCKING FLANGE ASSEMBLY FOR SPOOLS

[75] Inventor: Michael E. Schreiter, Calumet County, Wis.

[73] Assignee: Reynolds Consumer Products, Inc., Richmond, Va.

[21] Appl. No.: 747,823

[22] Filed: Aug. 21, 1991

[51] Int. Cl.[5] ..... B65D 85/66; B65D 85/67

[52] U.S. Cl. ..... 206/391; 206/389; 206/504; 242/118.4

[58] Field of Search ..... 206/389, 391, 412, 416, 206/504; 220/23.4; 242/118.4

[56] References Cited

U.S. PATENT DOCUMENTS

| | | | |
|---|---|---|---|
| T947,001 | 6/1976 | Mavredes | 206/504 |
| 3,164,252 | 1/1965 | Hosbein | 206/391 |
| 3,338,452 | 8/1967 | Oakley et al. | 220/23.4 |
| 3,341,053 | 9/1967 | Keene | 206/504 |
| 3,343,705 | 9/1967 | Erickson | 220/23.4 |
| 3,489,314 | 1/1970 | Slapnik | 206/504 |
| 3,593,861 | 7/1971 | Holland, Jr. | 206/504 |
| 3,599,828 | 8/1971 | Conway | 206/391 |
| 3,606,002 | 9/1971 | Miller | 206/65 R |
| 3,851,936 | 12/1974 | Muller | 206/504 |
| 4,058,216 | 11/1977 | Tsuyuguchi | 206/597 |
| 4,253,570 | 3/1981 | O'Connor et al. | 206/391 |
| 4,416,373 | 11/1983 | DeLaroisiere | 206/504 |
| 4,426,056 | 1/1984 | Gelardi et al. | 220/23.4 |
| 4,685,633 | 8/1987 | Pellini | 242/85 |
| 4,863,028 | 9/1989 | Cosaert | 206/391 |

*Primary Examiner*—David T. Fidei
*Attorney, Agent, or Firm*—Alan T. McDonald

[57] ABSTRACT

An interlocking flange assembly for spools includes a first multi-sided end plate. A plurality of interlocking male channel members are provided on adjacent pairs of sides of the first end plate and a plurality of female channel members are provided on the remaining sides of the end plate diametrically opposite the sides with the male channel members. The assembly includes a second multiple sided end plate that is identical to the first multiple sided end plate. The first and second end plates are secured to opposite ends of a spool. Once the flange assembly is attached to the opposite ends of a spool, a plurality of a spool and end plates may be interconnected for storage or transportation.

2 Claims, 1 Drawing Sheet

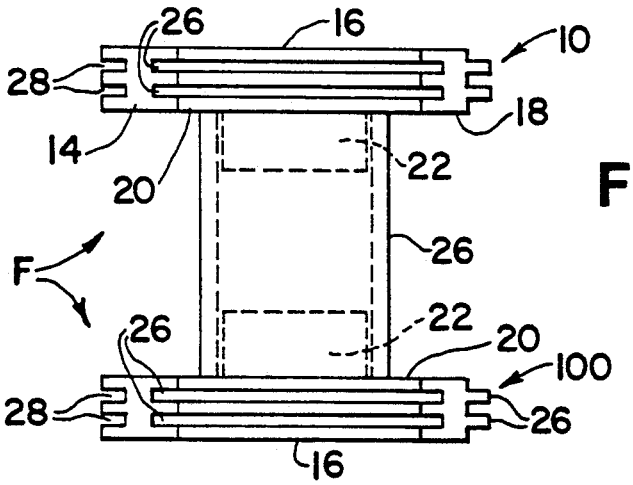
Fig. 1
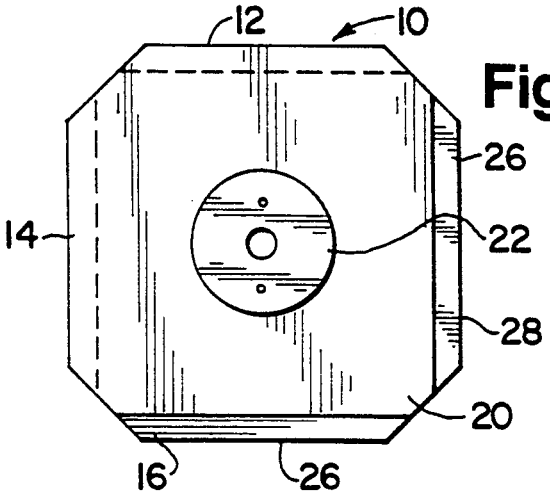
Fig. 2
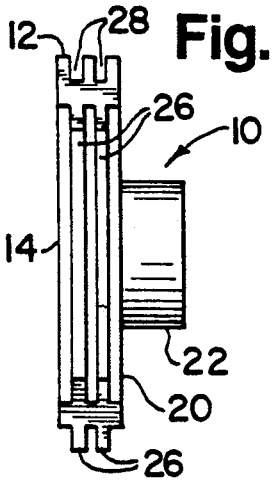
Fig. 3
Fig. 4
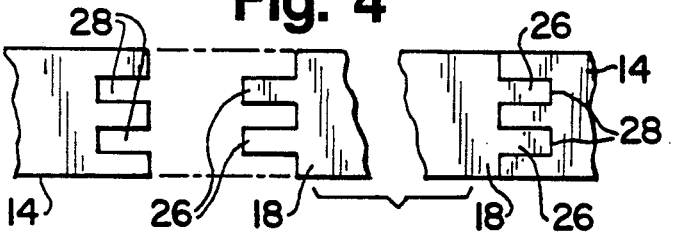
Fig. 5
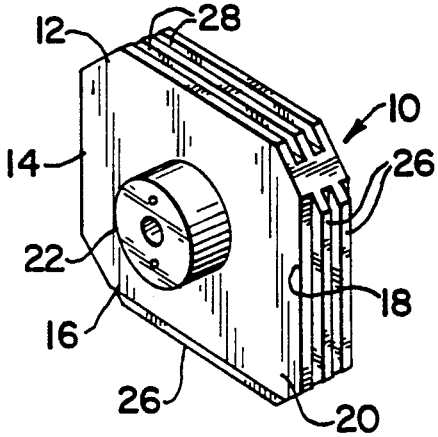

INTERLOCKING FLANGE ASSEMBLY FOR SPOOLS

BACKGROUND OF THE INVENTION

A. Field of the Invention

The present invention relates generally to a new and improved assembly for interlocking side or end plates of spools; and more specifically, to a new and improved assembly, including end plates for allowing spools to be interlocked.

B. Description of the Prior Art

In order to transport a large number of spools, it is desirable to connect or interlock the spools together on skids that can be stacked on top of each other. One example of interlocking spools for storing and transporting materials is disclosed in U.S. Pat. No. 4,253,570. In this patent a cap is placed on a hollow shell spool. The cap includes dovetail slots and tabs on the edges of the cap to allow two or four spools to be banded together in an assembly for stacking. A hollow platform on a spool end opposite the cap includes a male tab and female slot that are mated when the spools are secured together. The use of dovetail tabs and slots make interconnecting of the end caps difficult since the spools must be raised relative to one another to lock the tabs in the corresponding slots. To unlock the spools and end caps, each spool must be lifted relative to the other spools.

Another example of interlocking end caps of spools is provided in U.S. Pat. No. 3,606,002. In this patent, cylindrical cores are inserted within notches formed in end caps, thereby stabilizing and maintaining the cores in the preferred alignment.

Other means of other interlocking rolls or spools include end caps with multiple flat sides. The flat sides are laid against each other and strapping or a similar type wrapping is wound around the end caps holding the end caps and spools together as a single package, such a system is disclosed in U.S. Pat. No. 4,058,216. This system is complex in that it requires additional strapping to maintain the stack together, and if the strapping is removed, the entire stack must be disassembled.

SUMMARY OF THE INVENTION

Briefly, the present invention is directed to a new and improved flanged assembly for interconnecting spools carrying material wound thereon. The flange assembly includes a first multiple sided end or side plate with an attachment member for attaching the first end plate to a first end of a spool. Adjacent pairs of sides of the first end plate each includes a plurality of interlocking male channel members in the form of tongues. The remaining sides of the first end plate diametrically opposite the sides with the interlocking male channel members each includes a plurality of interlocking female channel elements in the form of grooves.

The flange assembly also includes a second multiple sided end or side plate with an attachment member for attaching the second end plate to a second end of a spool. Like the first end plate, the second end plate includes a plurality of interlocking male channel members in the form of tongues on adjacent pairs of sides of the second end plate. The remaining sides of the second end plate include interlocking female channel elements in the form of grooves.

With a flange assembly on each of a plurality of spools, the spools are interlocked by sliding the spools together. This action sides a male channel element or tongue into a female channel element or groove of an adjacent spool thereby interlocking the spools together by way of the flange assemblies. To unlock the spools, the adjacent spools are slid away from each other to disengage the male and female channel elements. No lifting or twisting of the spools is necessary to lock or unlock adjacent spools.

BRIEF DESCRIPTION OF THE DRAWINGS

The above and other objects and advantages and novel features of the present invention will become apparent from the following detail description of a preferred embodiment of the invention illustrated in the accompanying drawings:

FIG. 1 is a vertical side view of a spool including a flange assembly constructed in accordance with the principles of the present invention;

FIG. 2 is a top plan view of a first end plate of the flange assembly of the present invention;

FIG. 3 is a side view of the first end plate;

FIG. 4 is an enlarged, partially cut away view of a portion of an end plate illustrating the interlocking channel elements in the unlocked and the locked positions; and FIG. 5 is a perspective view of the first end plate.

The invention is susceptible to various modifications and alternative forms, and it should be understood that it is not intended to limit the invention to any particular form disclosed. On the contrary, the intention is to cover all modifications, equivalents, and alternatives falling within the spirit and scope of the invention as defined by the appended claims.

DESCRIPTION OF THE PREFERRED EMBODIMENT

Referring to FIGS. 1–5, there is illustrated a flange assembly generally designated by the reference letter F. The flange assembly F includes a first side or end plate 10 and a second side or end plate 100. Since the end plates 10 and 100 are identical, the same reference numerals will be used for each element that is the same in both end plates 10 and 100.

The first end plate 10 is multiple sided including a first side 12, a second side 14, a third side 16, and fourth side 18. The end plate 10 includes a bottom 20 to which is secured or form an attachment member 22. The attachment member 22 serves to attach the first end plate 10 to a spool 24 as illustrated in FIG. 1. The spool 24 is intended to have material such as paper, strap or similar type material wrapped thereon.

The multiple sided end plate 10 includes interlocking male channel elements 26 on alternating adjacent pairs of sides. In the embodiment illustrated, the first end plate 10 is square and sides 16 and 18 include the male channel elements 26. The end plate 10 can be of any configuration that has an even number of linear or straight sides. The male elements 26 are on each of alternating pairs of sides. The interlocking male channel elements 26, in the preferred embodiment illustrated, are tongues. On the remaining sides 12 and 14 diametrically opposite from sides 16 and 18, interlocking female channel elements 28 are provided. In the preferred embodiment, these female channel elements 28 are grooves.

As best illustrated in FIG. 4, the tongues 26 are configured so as to slide securely into the grooves 28 to lock adjacent multiple sided end plates 10. Once the first multiple sided end plate 10 is secured to one end of the spool 24 and a second multiple sided end plate 100 is attached to second end of the spool 24, adjacent spools 24 may be interlocked by sliding the spools 24 and the end plates 10 and 100 together to slide the tongues 26 into the channels 28. In the same manner, adjacent spools 24 may be unlocked by sliding the spools 24 and end plates 10 and 100 away from each other as illustrated in FIG. 4.

If desired, the interlocked spools 24 may be mounted on a skid and stored in stacked relation or transported by a vehicle. Through the use of the interlocking multiple sided end plates 10 and 100, no lifting or twisting of adjacent spools is necessary to interlock the spools.

I claim:

1. An interlocking assembly for spools, comprising:

a first side plate for placement on a first end of a spool;

a first linear end on said first side plate;

a first female interlocking member extending for the length of said first linear end;

a second linear end on said first side plate;

a first male interlocking member on said second linear end capable of laterally and longitudinally sliding into locking engagement with a female interlocking member on a first adjacent spool;

a third linear end on said first side plate;

a second female locking member extending for the length of said third linear end;

a fourth linear end on said first side plate;

a second male interlocking member on said fourth linear end capable of laterally and longitudinally sliding into locking engagement with a female interlocking member on a second adjacent spool;

a second side plate for placement on a second end of said spool;

a fifth linear end on said second side plate;

a third female interlocking member extending for the length of said fifth linear end;

a sixth linear end on said second side plate;

a third male interlocking member on said sixth linear end capable of laterally and longitudinally sliding into locking engagement with a female interlocking member on said first adjacent spool;

a seventh linear end on said second side plate;

a fourth female locking member extending for the length of said seventh linear end;

an eighth linear end on said second side plate; and a fourth male interlocking member on said eighth linear end capable of laterally and longitudinally sliding into locking engagement with a female interlocking member on said second adjacent spool.

2. The interlocking flange assembly for spools of claim 1 wherein said male locking members are tongues and said female interlocking members are grooves, each extending perpendicular to said linear ends.

* * * * *